US007870769B2

(12) United States Patent
Andersson

(10) Patent No.: US 7,870,769 B2
(45) Date of Patent: Jan. 18, 2011

(54) ELECTROMECHANICAL LOCK DEVICE

(75) Inventor: Daniel Andersson, Eskilstuna (SE)

(73) Assignee: ASSA AB, Eskilstuna (SE)

( * ) Notice: Subject to any disclaimer, the term of this patent is extended or adjusted under 35 U.S.C. 154(b) by 0 days.

(21) Appl. No.: 11/912,620

(22) PCT Filed: Apr. 27, 2006

(86) PCT No.: PCT/SE2006/000505

§ 371 (c)(1),
(2), (4) Date: Jan. 16, 2008

(87) PCT Pub. No.: WO2006/118520

PCT Pub. Date: Nov. 9, 2006

(65) Prior Publication Data

US 2008/0156053 A1 Jul. 3, 2008

(30) Foreign Application Priority Data

Apr. 29, 2005 (SE) ..... 0500976

(51) Int. Cl.
*E05B 49/00* (2006.01)
*E05B 47/05* (2006.01)

(52) U.S. Cl. ..... 70/278.7; 70/278.3; 70/283; 70/496

(58) Field of Classification Search ..... 70/278.3, 70/278.7, 283, 283.1, 495, 496, 276, 277, 70/278.1, 278.2, 279.1
See application file for complete search history.

(56) References Cited

U.S. PATENT DOCUMENTS 5,255,547 A * 10/1993 Burr et al. ..... 70/496
5,351,042 A * 9/1994 Aston ..... 70/278.3
5,542,274 A * 8/1996 Thordmark et al. ..... 70/496
5,552,777 A * 9/1996 Gokcebay et al. ..... 70/278.3
6,363,762 B1 * 4/2002 Kueng ..... 70/278.3
6,374,653 B1 * 4/2002 Gokcebay et al. ..... 70/278.3

(Continued)

FOREIGN PATENT DOCUMENTS

EP 1134335 A2 9/2001

(Continued)

*Primary Examiner*—Suzanne D Barrett
*Assistant Examiner*—Christopher Boswell
(74) *Attorney, Agent, or Firm*—Sughrue Mion, PLLC

(57) ABSTRACT

A lock device comprises a housing (2) which includes an opening (4) and a core (10) which is rotatably disposed in the opening and which includes a key way (12) for reception of a key. A latching element (20) co-acts between the housing (2) and the core (10) and is movable between a release position in which the core is rotatable relative to the housing, and a latching position in which rotation of the core relative to the housing is blocked. An electronically controllable actuator (30) is disposed in the core and is rotatable between an opening-registering-position in which the latching element is movable to the release position, and a latching position in which movement of the latching element to said release position is blocked. A spring (46) abuts an abutment portion (30*c*) of the actuator. Since the spring is provided with two mutually parallel leg portions (46*d*, 46*e*), which abut radially opposite surfaces of the abutment portion of the actuator, several advantages are obtained. Firstly, the damping spring is easily assembled without any fixation in the core. Furthermore, the balancing ensures that a predetermined force is exerted on the neck portion, which increases the accuracy and thereby the performance.

10 Claims, 4 Drawing Sheets

U.S. PATENT DOCUMENTS

| | | | | |
|---|---|---|---|---|
| 6,442,986 | B1 * | 9/2002 | Russell et al. | 70/278.3 |
| 6,564,601 | B2 * | 5/2003 | Hyatt Jr. | 70/278.3 |
| 6,826,935 | B2 * | 12/2004 | Gokcebay et al. | 70/278.3 |
| 6,840,072 | B2 * | 1/2005 | Russell et al. | 70/278.3 |
| 2002/0189307 | A1 * | 12/2002 | Gokcebay et al. | 70/278.3 |
| 2004/0080039 | A1 | 4/2004 | Araya | |

FOREIGN PATENT DOCUMENTS

| | | | |
|---|---|---|---|
| WO | 0148341 | A1 | 7/2001 |
| WO | 03100199 | A1 | 12/2003 |
| WO | 2004051033 | A1 | 6/2004 |
| WO | 2005001224 | A1 | 1/2005 |

* cited by examiner

ELECTROMECHANICAL LOCK DEVICE

FIELD OF INVENTION

The present invention relates generally to an electromechanical lock device and then particularly to a lock device in which an electrically or electromechanically actuated latch mechanism is spring biased for improved security and better performance.

BACKGROUND OF THE INVENTION

Electromechanical lock devices that include an electrically co-acting or controlled release mechanism for manoeuvring a lock cylinder are known to the art. Such lock devices are described in for example U.S. Pat. No. 5,839,307 and the Swedish patent SE 9904771-4. It is there described how an actuator is rotated by means of an electric motor. The actuator in turn permits or prevents the movement of a side bar. A way to manipulate such a latch mechanism is to try to hammer on the lock or in another way try to rotate the actuator to the release position.

The European patent publication EP 1 134 335 A2 describes a lock device, wherein a spring is used for mechanically returning an actuator to a latching position. This design is shown in FIG. 1, wherein it is evident that a returning pin presses on a leg of the spring, which in turn presses on a toothed surface of an actuator. The spring disclosed in this document is fixated by means of a cover and has returning of the actuator to latching position as only function. It is also comparatively complex to assemble.

SUMMARY OF THE PRESENT INVENTION

An object of the present invention is to provide a lock device of the above kind in which the electrically controlled latch mechanism exhibits higher security as well as better performance than known devices and which also is easier to assemble.

The invention is based on the insight that a spring acting on an actuator can be provided with two legs, which abut either side of an abutment portion of the actuator.

Accordingly, the invention provides a lock device according to claim 1.

One advantage afforded by the inventive lock device is that the damping spring prevents overshoots during rapid rotation of the actuator. This can thereby be rotated more quickly between its end positions. Since the two legs of the damping spring all the time abut the abutment portion of the actuator, manipulation of the latch mechanism is made more difficult to achieve by means of hammering or the like. Self balancing is achieved by two legs abutting the abutment portion of the actuator. This has several advantages. Firstly, the damping spring can be easily assembled without any fixation in the core. Furthermore, the balancing ensures that a predetermined force is applied on the neck portion, which increases accuracy and therewith performance.

BRIEF DESCRIPTION OF THE DRAWINGS

The invention will now be described by way of example and with reference to the accompanying drawings, in which.

DETAILED DESCRIPTION OF THE INVENTION

Figure 1:
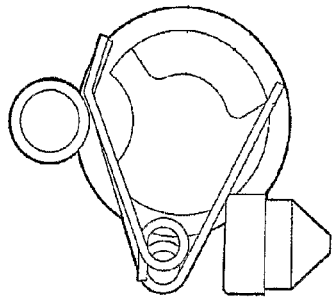
Fig. 1 (Prior art)
FIG. 1 illustrates a latch mechanism of a lock device constructed in accordance with known technology.

There follows a detailed description of preferred embodiments of the invention. FIG. 1 illustrates known technology which has already been described in the background section of the present specification and will not be discussed further.

Figure 2:
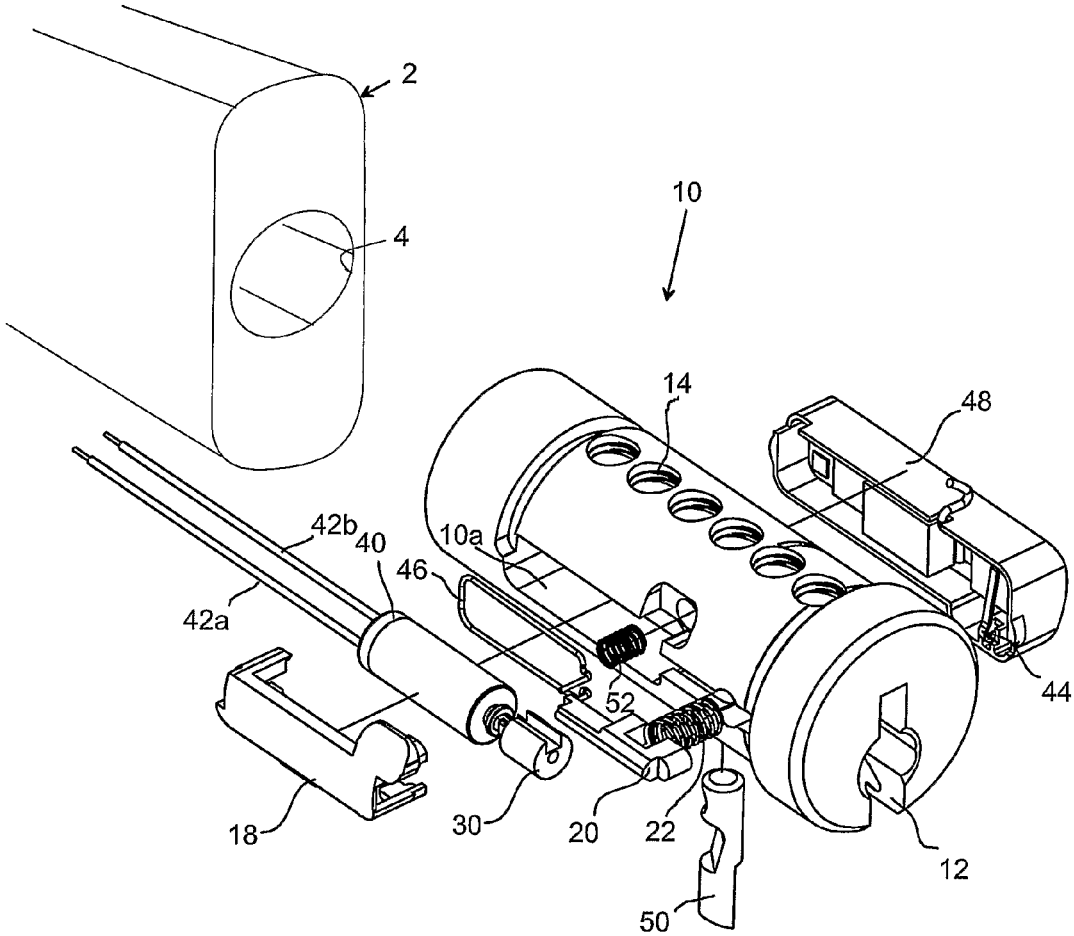
FIG. 2 is a perspective view of a lock device according to the present invention.
Figure 3A:
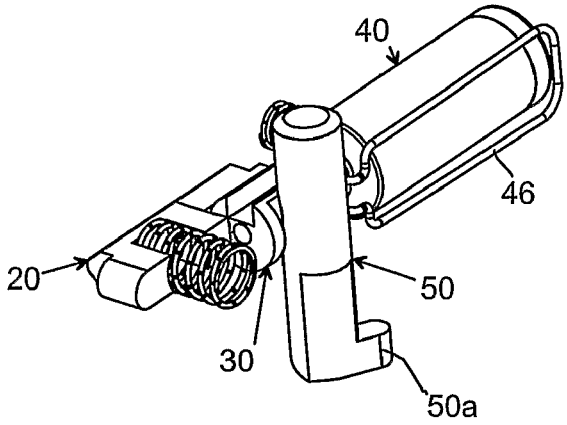
FIGS. 3*a* and 3*b* illustrate in detail a latch mechanism that comprises a side bar, an actuator, a motor, a pivotal pin, and a damping spring included in a lock device according to the present invention.
Figure 3B:
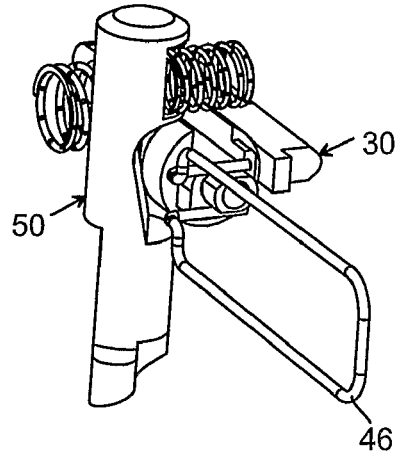
Figure 4A:
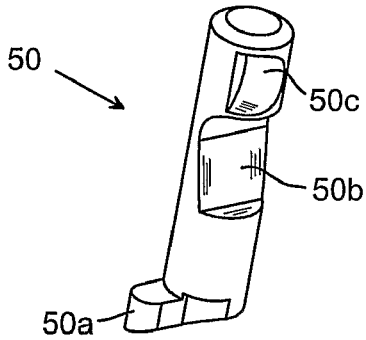
FIGS. 4*a* and 4*b* illustrate in detail the pivotal pin shown in FIGS. 3*a* and 3*b;*
Figure 4B:
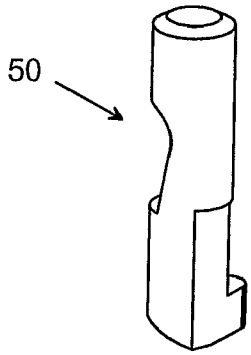

FIG. 2 is an exploded view of a cylinder core, generally referenced 10, in a lock device constructed in accordance with the invention. The core 10 is structured for placement in a circular-cylindrical opening 4 in a typical cylinder housing 2 and the core will therefore have an outer surface which corresponds essentially to the housing opening. The core includes a key way 12 which is configured to receive a key (not shown) in a typical fashion. The core 10 includes a plurality of pin tumbler openings 14 which receive tumbler pins (not shown) in a typical fashion. The manner in which an appropriately profiled key contacts the tumbler pins and places them on a parting line so that the core 10 can be rotated relative to the lock housing is known in the art and will not therefore will be described here in more detail.

The function or modus operandi of the tumbler pins is ignored throughout the entire description, and it is assumed and an appropriately profiled key has been inserted in the lock. When it is said, for instance, that the core is blocked or latched it is meant that the core is blocked by the electrically controlled latch mechanism.

FIG. 2 also illustrates a side bar 20 which is spring biased radially outwards by a spring 22 acting on the side bar. The function or modus operandi of the side bar is described for example in the Swedish patent application No. 7906022-4, which is incorporated herein by reference.

The core also includes a generally cylindrical actuator 30 which can be rotated by means of a motor 40. The motor is connected to an electronic module 48 by means of two conductors 42*a*, 42*b*. These conductors are intended to extend in a groove in the barrel surface of the core. In addition to a custom-made micro-regulating unit with associated memories for storing and executing software together with drive circuits for driving the motor 40 etc, the electronic module also includes a key contact 44 in the form of an electrically conductive metal strip which is intended to make mechanical contact with a key inserted in the key channel 12. This enables the key and the electronic module to exchange electrical energy and data. Thus, a battery powering the motor 40 and the electronic module 48 can be placed either in the lock device or in the key. A damping spring 46 is provided radially inwards of the motor for damping rotation of the motor 40.

Rotation of the actuator 30 can also be influenced by a pivotal pin 50 which has a rotational axle that extends generally at right angles to the rotational axis of the actuator. The pivotal pin is disposed in a channel 16 (not shown) that extends up to the key way 12

The side bar 20, the actuator 30 and the motor 40 with associated components, such as the damping spring 46, are disposed in a recess 10*a* in the barrel surface of the core and are held in place by a cover 18. Correspondingly, the electronic module 48 is disposed in a recess in the barrel surface of the core opposite the recess 10*a*.

The latch mechanism comprising the side bar 20, the actuator 30, the motor 40, the damping spring 46, and the pivotal pin 50 will now be described in detail with reference to FIGS. 3*a*, 3*b*-5*a*, 5*b*. The pivotal pin 50 includes a peg 50*a* which is intended to co-act with a key inserted in the keyway 12. The pivotal pin also includes a recess 50*b* which has a surface that is intended for co-action with a surface 30*b* on the actuator 30. The pivotal pin also includes a seating 50*c* for the pivotal pin spring 52.

Figure 5A:
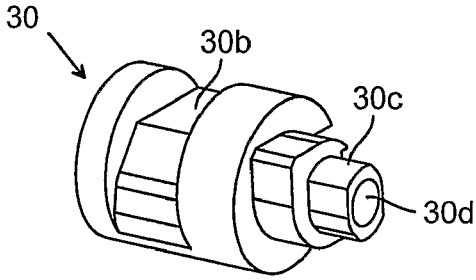
FIGS. 5*a* and 5*b* illustrate in detail the actuator shown in FIGS. 3*a* and 3*b;*
Figure 5B:
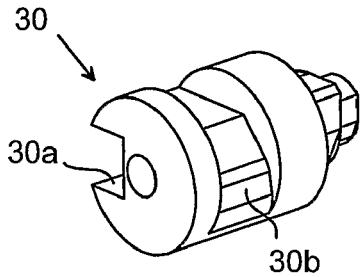
Figure 6:
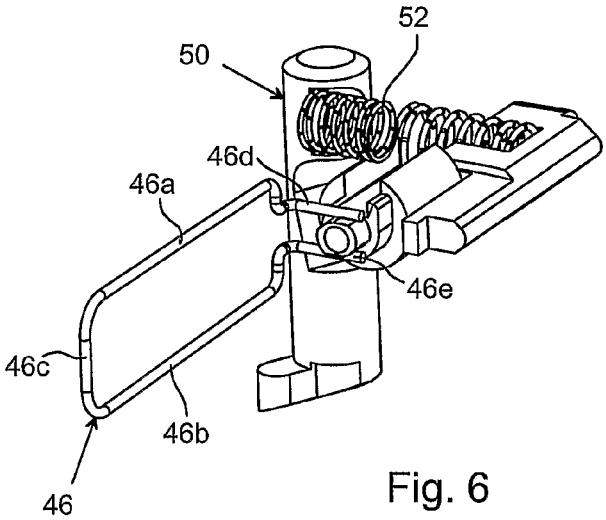
FIG. 6 illustrates a perspective view of the latch mechanism excluding the motor, showing interaction between the actuator and the damping spring.

The barrel surface of the actuator 30 is generally cylindrical in shape and includes a longitudinally extending recess 30*a* which is intended to accommodate a part of the side bar 20 when the actuator is located in a release position. The barrel surface of the actuator also includes a recess 30*b* which extends around the midway portion of the actuator through an angle of about 225 degrees, as shown in FIGS. 5*a* and 5*b*. This recess is intended for co-action with the bottom surface of the pivotal pin recess 50*b* for mechanical returning of the actuator. The actuator 30 also includes a neck portion 30*c* which is intended for co-action with the damping spring 46 such as to dampen excessive movement of the actuator and to render manipulation of the lock by hammering against the lock difficult to achieve, which will be explained further below. Finally, the actuator also includes an axially extending hole 30*d* for accommodating a shaft of the motor 40.

The interaction between the actuator 30 and the damping spring 46 will now be explained with reference to FIGS. 6, 7, and 8*a*-*d*. The damping spring 46, which is preferably made of stainless spring steel, comprises first and second essentially straight long side portions 46*a*, 46*b*, which are interconnected via an essentially straight short side portion 46*c*. The long side portions and the short side portion are thus provided in one plane. In the end opposite to the short side portion 46*c* the long side portions 46*a*, 46*b* turn into a respective leg portion 46*d*, 46*e*, which extends essentially perpendicularly to the plane defined by the long side portions and the short side portion.

The leg portions 46*d*, 46*e* extend mutually parallel to each other.

Figure 7:
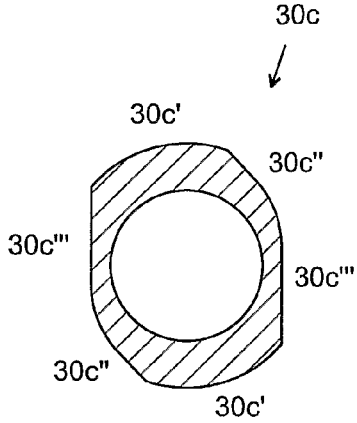
FIG. 7 illustrates a cross-section of the neck portion of the actuator.

The leg portions 46*d*, 46*e* squeeze the neck portion 30*c* of the actuator, which is provided with a varying radius, see FIG. 7. In this figure there is shown a cross-section of the neck portion 30*c* of the actuator in level with the spring legs. The neck portion is rotationally symmetric and exhibits first periphery portions, designated 30*c*' in the figure, with essentially constant radius. These portions turn into second periphery portions 30*c*" having a decreasing radius. Third periphery portions 30*c*'" are essentially planar. The two leg portions 46*d*, 46*e* of the damping spring 46 simultaneously abut corresponding periphery portions thanks to the rotational symmetry.

The leg portions 46*d*, 46*e* always abut radially opposite surfaces of the neck portion 30*c* of the actuator. They thereby exert equally large but oppositely directed forces on the neck portion 30*c* of the actuator, whereby self-balancing is achieved. This entails several advantages. Firstly, the damping spring can be assembled without any fixation in the core. It is sufficient that it is simply placed radially inside of the motor 40 like in the illustrated example and thereby is kept in place. It thus provides for easy assembly. Furthermore, the balancing ensures that a predetermined force is exerted on the neck portion, increasing accuracy and thereby performance.

The long sides 46*a*, 46*b* of the spring are preferably made as long as possible in order to obtain good dynamics for the spring. In the present example they have a length which essentially corresponds to the length of the motor 40, approximately 10 millimeters.

Figure 8A:
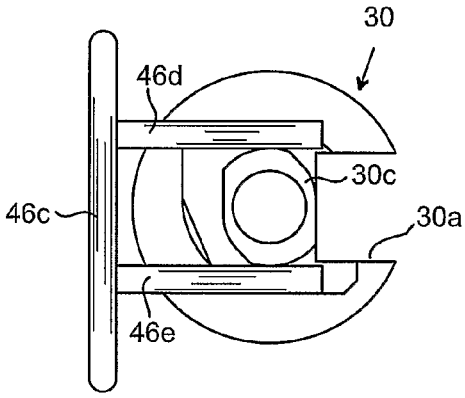
FIG. 8*a-d* illustrate different end views of the actuator and the damping spring in different rotational positions of the actuator.
Figure 8B:
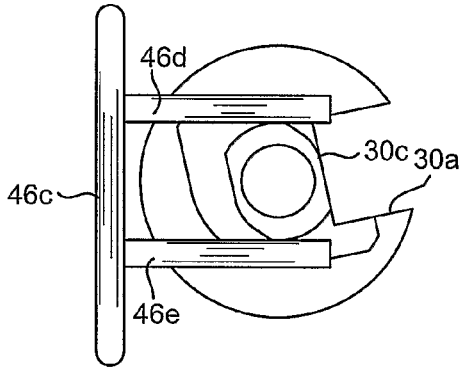
Figure 8C:
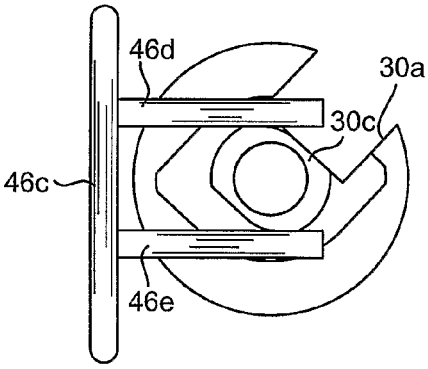
Figure 8D:
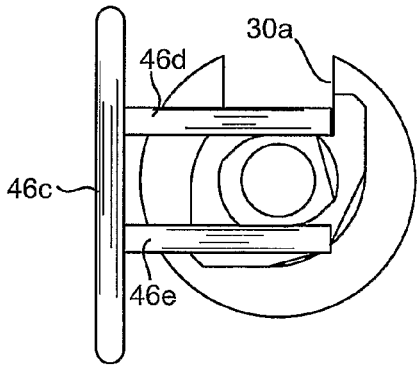

The function of the shape of the neck portion will now be described with reference to FIG. 8*a*-*d*. In FIG. 8*a* the actuator 30 is illustrated in a release position, wherein the recess 30*a* of the actuator provided for the side bar faces the side bar. In this position the lock device is electrically open since the side bar does not prevent rotation of the core 10, wherein the leg portions 46*d*, 46*e* abut the first periphery portions 30*c*'. When the actuator begins to be rotated by means of the motor, the leg portions are moved towards the periphery portions 30*c*", exhibiting a decreasing radius to the legs when the actuator is rotated from the release position. In FIG. 8*b* a position is illustrated, wherein the actuator has been rotated approximately 10 degrees from the position shown in FIG. 8*a*. In FIG. 8*c* there is shown a position after further rotation, wherein the actuator has been rotated in total approximately 45 degrees. If the actuator in this position is exposed to vibrations, such as during so-called hammering, then the forces exerted by the damping spring 46 on the neck portion 30*c* would bring a rotation of the actuator towards the latching position illustrated in FIG. 8*d*, wherein the actuator has been rotated in total approximately 90 degrees. In this position the leg portions 46*d*, 46*e* of the damping spring abut the periphery portions 30*c*'". The actuator has a resting position in the latching position of FIG. 8*d* since these portions are essentially planar. This means in turn that vibration of the actuator in this position would bring the actuator no rotation, which to a large extent makes manipulation more difficult.

Besides functioning as a protection against manipulation, the damping spring also functions to dampen overshoots during rapid change of the rotational position of the actuator. In order to avoid delays in the locking function, as short rotation time as possible is desired for rotation of the actuator between the release position in FIG. 8*a* and the latching position in FIG. 8*d*. Thanks to the friction between the damping spring and the neck portion of the actuator, a very high rotational speed is possible while overshoots in the end positions are avoided when the rotational speed rapidly goes to zero.

Figure 9:
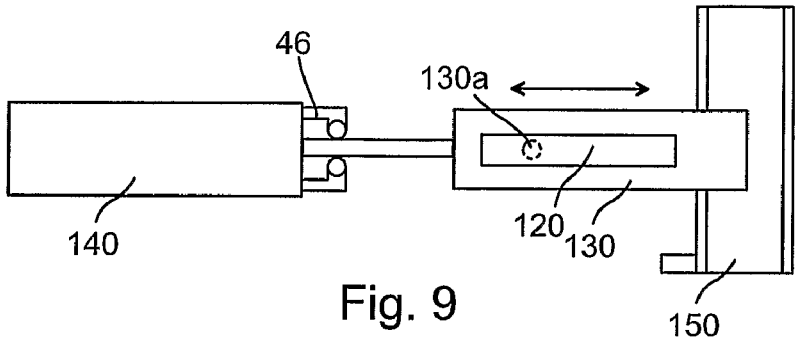
FIG. 9 illustrates a side view of the latch mechanism in an alternative embodiment of the invention.
Figure 10A:
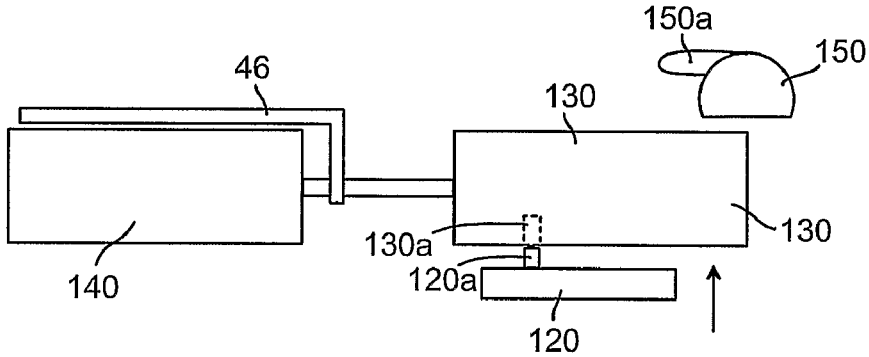
FIG. 10*a-c* illustrates top views of the latch mechanism shown in FIG. 9.
Figure 10B:
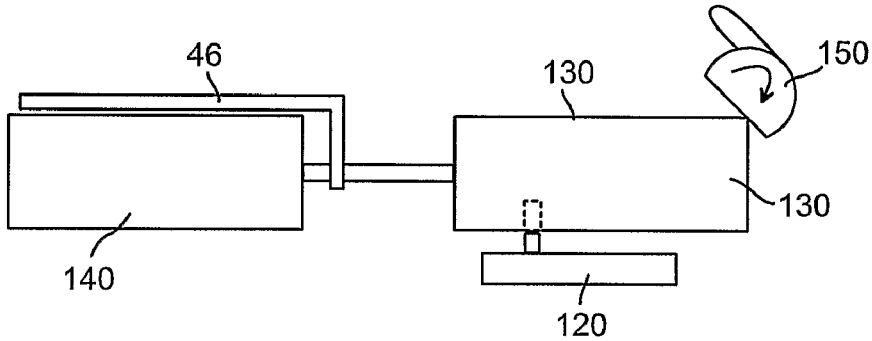
Figure 10C:
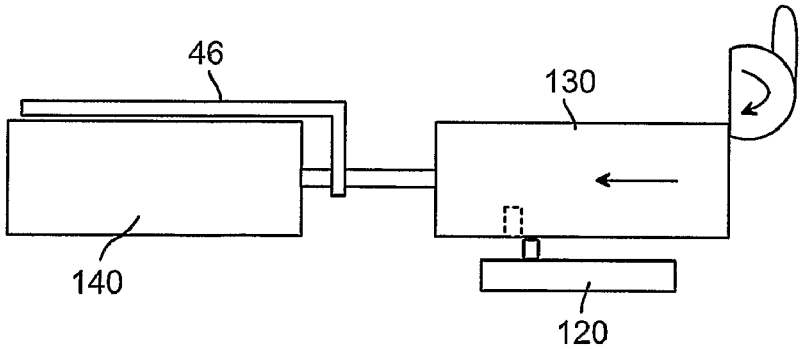

In an alternative embodiment shown in FIGS. 9 and 10, the motor 40 having a rotating shaft has been replaced by a linearly working motor or solenoid 140. This is connected to an actuator 130 which is movable in a longitudinal direction. A hole 130*a* is provided in the actuator 130, which hole is arranged to receive a pin 120*a* on a side bar 120. In the position illustrated in FIG. 10 the side bar can thus be moved towards the actuator since its pin is in registry with the hole 130*a*.

A damping spring 146 corresponding to the above described spring 46 abuts the shaft interconnecting motor and actuator, wherein the shaft is considered to be part of the actuator. This damping spring thus has the same general shape as in the first embodiment. The function thereof is also to dampen the movement of the motor shaft and to make manipulation more difficult, although the motor shaft undergoes only linear movement and no rotational movement. The motor shaft can be provided with varying diameter in the longitudinal direction if so desired.

A pivotal pin 150 corresponding to the pin of the first embodiment is provided for mechanical movement of the actuator during removal of the key from the lock device. It is thus provided with a tap 150*a* or other means making it possible to influence by means of a key inserted into the lock device. It is also spring biased by means of a spring (not shown). During turning of the pivotal pin, see FIG. 13*b*, a surface thereof presses against the end surface of the actuator, wherein the actuator is given a linear movement in direction of the motor, see FIG. 13*c*. The hole 130*a* is thereby moved out of registry with the pin 120*a* of the side bar 120 and the side bar is thereby prevented from being moved inwardly towards the actuator. The actuator 130 is thereby given the same function as the rotating actuator 30 in the first embodiment.

Preferred embodiments of a lock device according to the invention have been described above. The person skilled in the art realizes that these can be varied within the scope of the appended claims.

The electric operation of the actuator to its latching position has been described as a 90 degrees rotation. It will be appreciated that other degrees also are feasible as long as the recess 30*a* for the side bar is not exactly facing the side bar.

It will be appreciated that the abutment portion that is defined by the neck portion of the actuator can have a different shape or place on the actuator.

It will be appreciated that, although a combination of an electrically controlled latch mechanism and conventional tumbler pins has been shown, the inventive idea is also applicable to lock devices lacking other latching than the described latching mechanism.

The damping spring 46 has been described with a specific shape. It will be appreciated that this spring can have a different shape as long as the spring exhibits two mutually parallel leg portions abutting radially opposite surfaces on the neck portion of the actuator or the shaft interconnecting the motor and actuator. The short side portion 46*c* can thus have a rounded shape.

The invention claimed is:

1. A lock device comprising:

a housing (2) which includes an opening (4);

a core (10) which is rotatably mounted in the opening (4) and which includes a key way (12) for reception of a key;

a latching element (20;120) which co-acts between the housing (2) and the core (10) and which is movable between a release position in which the core is rotatable relative to the housing, and a latching position in which rotation of the core relative to the housing is blocked;

an electronically controllable actuator (30; 130) which is mounted in the core (10) and which is movable between an opening-registering position in which movement of the latching element (20; 120) to the release position is permitted, and a latching position in which movement of the latching element to said release position is blocked; and a spring (46) abutting an abutment portion (30*c*) of the actuator; characterized in that the spring is provided with two leg portions (46*d*, 46*e*) which are parallel to each other, and which abut radially opposite surfaces of the abutment portion of the actuator.

2. The lock device according to claim 1, wherein the spring, comprises first and second essentially straight long side portions (46*a*, 46*b*), which are interconnected via a short side portion (46*c*).

3. The lock device according to claim 2, wherein the long side portions (46*a*, 46*b*) and the short side portion (46*c*) are provided in one plane.

4. The lock device according to claim 3, wherein the leg portions (46*d*, 46*e*) extend essentially perpendicularly to the plane defined by the long side portions and the short side portion.

5. The lock device according to claim 4, wherein the abutment portion of the actuator comprises a neck portion (30*c*) of the actuator.

6. The lock device according to claim 2, wherein the long side portions (46*a*, 46*b*) turn into a respective leg portion (46*d*, 46*e*) in the end opposite to the short side portion (46*c*).

7. The lock device according to claim 1, wherein the abutment portion of the actuator comprises a portion of a motor shaft connecting the actuator to a motor.

8. The lock device according to claim 1, wherein the abutment portion (30*c*) of the actuator is rotationally symmetric.

9. The lock device according to claim 1, wherein the abutment portion (30*c*) comprises first periphery portions (30*c*') having essentially constant radius, which turn into second periphery portions (30") having a decreasing radius.

10. The lock device according to claim 1, wherein the abutment portion (30*c*) comprises third periphery portions (30*c*'") which are essentially planar.

* * * * *